US006887140B2

(12) United States Patent
Bovone

(10) Patent No.: US 6,887,140 B2
(45) Date of Patent: May 3, 2005

(54) MACHINE FOR RADIUSING THE CORNERS OF GLASS SHEETS

(75) Inventor: Vittorio Bovone, Silvano d'Orba (IT)

(73) Assignee: Elettromeccanica Bovone S.r.l., Ovada (IT)

( * ) Notice: Subject to any disclaimer, the term of this patent is extended or adjusted under 35 U.S.C. 154(b) by 164 days.

(21) Appl. No.: 10/298,802

(22) Filed: Nov. 19, 2002

(65) Prior Publication Data

US 2003/0096563 A1 May 22, 2003

(30) Foreign Application Priority Data

Nov. 20, 2001 (IT) ..... MI2001A2445

(51) Int. Cl.[7] ..... B24B 9/10
(52) U.S. Cl. ..... 451/246; 451/44
(58) Field of Search ..... 451/246, 44, 190, 451/194, 57, 231, 127, 130, 132

(56) References Cited

U.S. PATENT DOCUMENTS 4,375,738 A 3/1983 Bando
5,197,229 A * 3/1993 Kanamaru et al. ..... 451/11

FOREIGN PATENT DOCUMENTS

| | | |
|---|---|---|
| DE | 28 27 917 | 1/1980 |
| JP | 10-291149 | 11/1998 |
| JP | 2001-239443 | 9/2001 |

* cited by examiner

*Primary Examiner*—Robert A. Rose
(74) *Attorney, Agent, or Firm*—Young & Thompson

(57) ABSTRACT

A machine for radiusing the corners of glass sheets (K) by tools (A, B, C) operated by an electric motor (33), in which the electric motor (33) is supported vertically movable by a first support structure (34), which is supported rotatable about vertical axis (Y) by a second support structure (13) moveable horizontally in two mutually perpendicular directions (X, R).

13 Claims, 7 Drawing Sheets

MACHINE FOR RADIUSING THE CORNERS OF GLASS SHEETS

BACKGROUND OF THE INVENTION

The present invention relates to a machine for radiusing the corners of glass sheets by the use of grinding wheels.

Glass sheets as obtained after cutting are most commonly of rectangular or square shape with four sharp corners, which as such are dangerous and in any event subject to easy breakage. These sharp corners are eliminated by rounding them ("radiusing" colloquially) with the aid of rotary grinding wheels, generally three in number, of which one is for roughing, the second is for finishing and the third is for polishing. For correct radiusing, templates are used, these being located with considerable precision to obtain a perfect result, but making in-line processing of the glass sheets difficult. In other words, the radiusing operation represents a slow-down in the continuity of a glass sheet processing line, this processing comprising cutting the sheets to shape, radiusing the corners and then applying surface treatment, for example washing and drying.

SUMMARY OF THE INVENTION

The main object of the present invention is to provide a machine which enables glass sheets to be radiused without using templates or similar equipment.

Another important object of the present invention is to provide a machine suitable for automatic in-line radiusing of glass sheets, hence without slowing down the processing line.

A further object of the present invention is to provide a machine for radiusing the corners of glass sheets which is of high productivity and is adaptable to sheets of different formats.

These and further objects which will be more apparent from the ensuing detailed description are attained by a machine in accordance with the teachings of the accompanying claims.

BRIEF DESCRIPTION OF THE DRAWINGS

The invention will be better understood from the following detailed description, provided by way of non-limited example and given with reference to the accompanying drawings, in which.

DESCRIPTION OF THE PREFERRED EMBODIMENTS

The machine of the invention, in its two embodiments described hereinafter, enables the sharp corners of square or rectangular glass sheets, of even considerably different dimensions, to be eliminated to provide corners which are rounded in the manner of circular arcs, are finished and are polished. The operation is known colloquially as "radiusing" and is implemented using grinding wheels and similar tools rotated by an electric motor.

Figure 7:
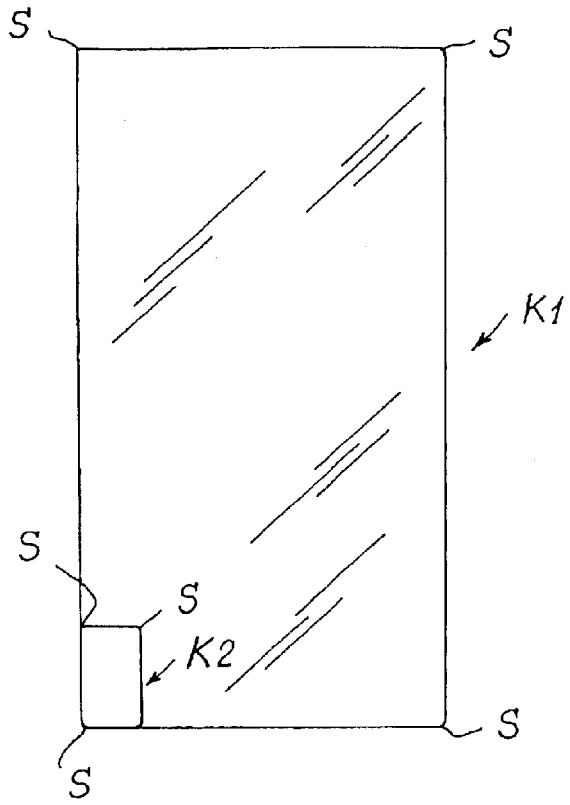
FIG. 7 shows two external sheet formats which can be radiused with the machine of the invention.

FIG. 7 shows two glass sheets of different format, indicated by K1 and K2, after radiusing the corners indicated by S. The radius of curvature of the "radiused" part can be equal (as in FIG. 7) for the two sheets or can be different. Generally the radius of curvature is chosen greater for sheets of larger format.

A radiusing machine must therefore be able to be easily and quickly adapted to the desired radius of curvature, ensuring in each case a transition without discontinuity between the radiused corners and those sides of the glass sheets to which they join.

Figure 4:
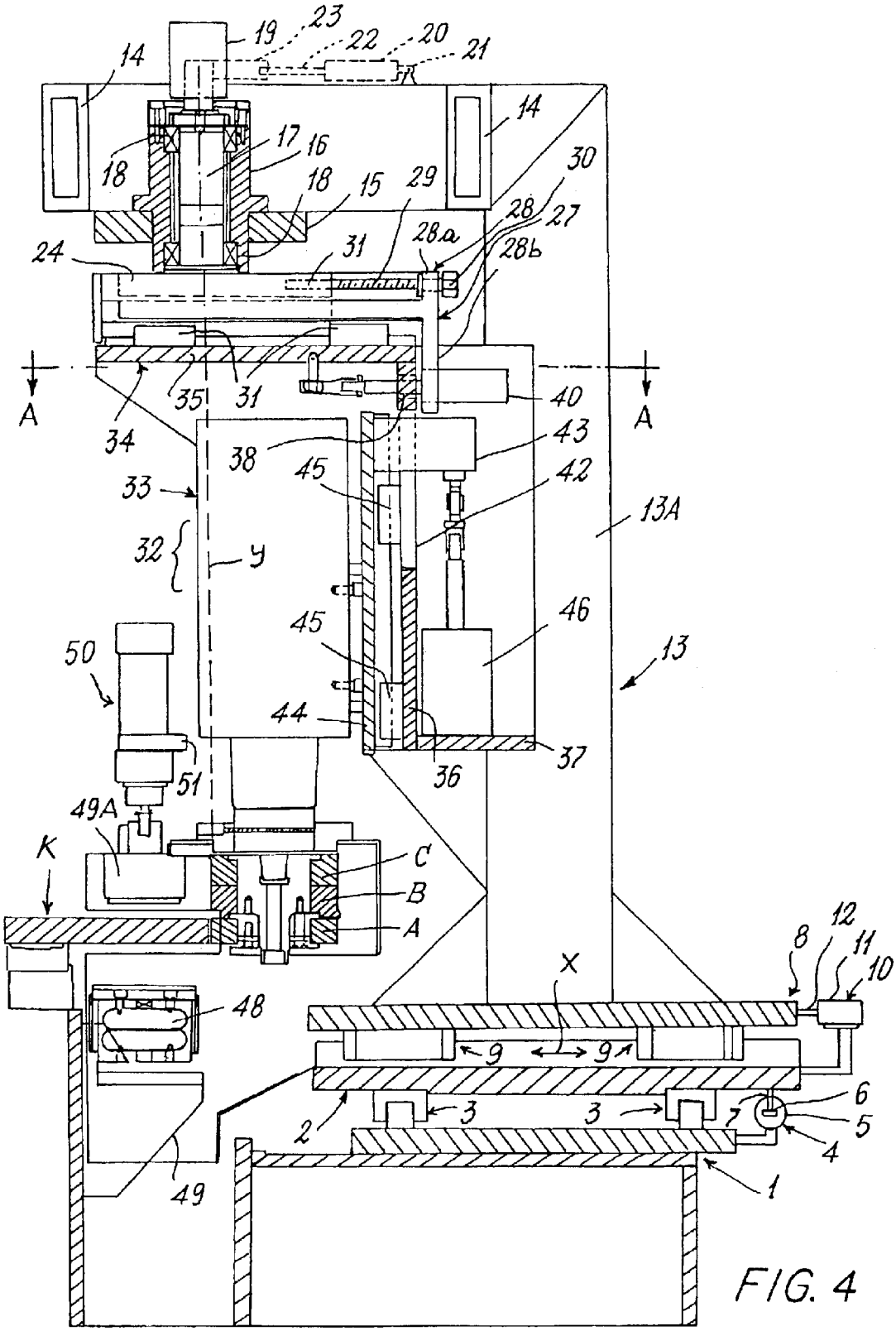
FIG. 4 is a vertical section through a single radiusing machine in accordance with the teachings of the invention.
Figure 5:
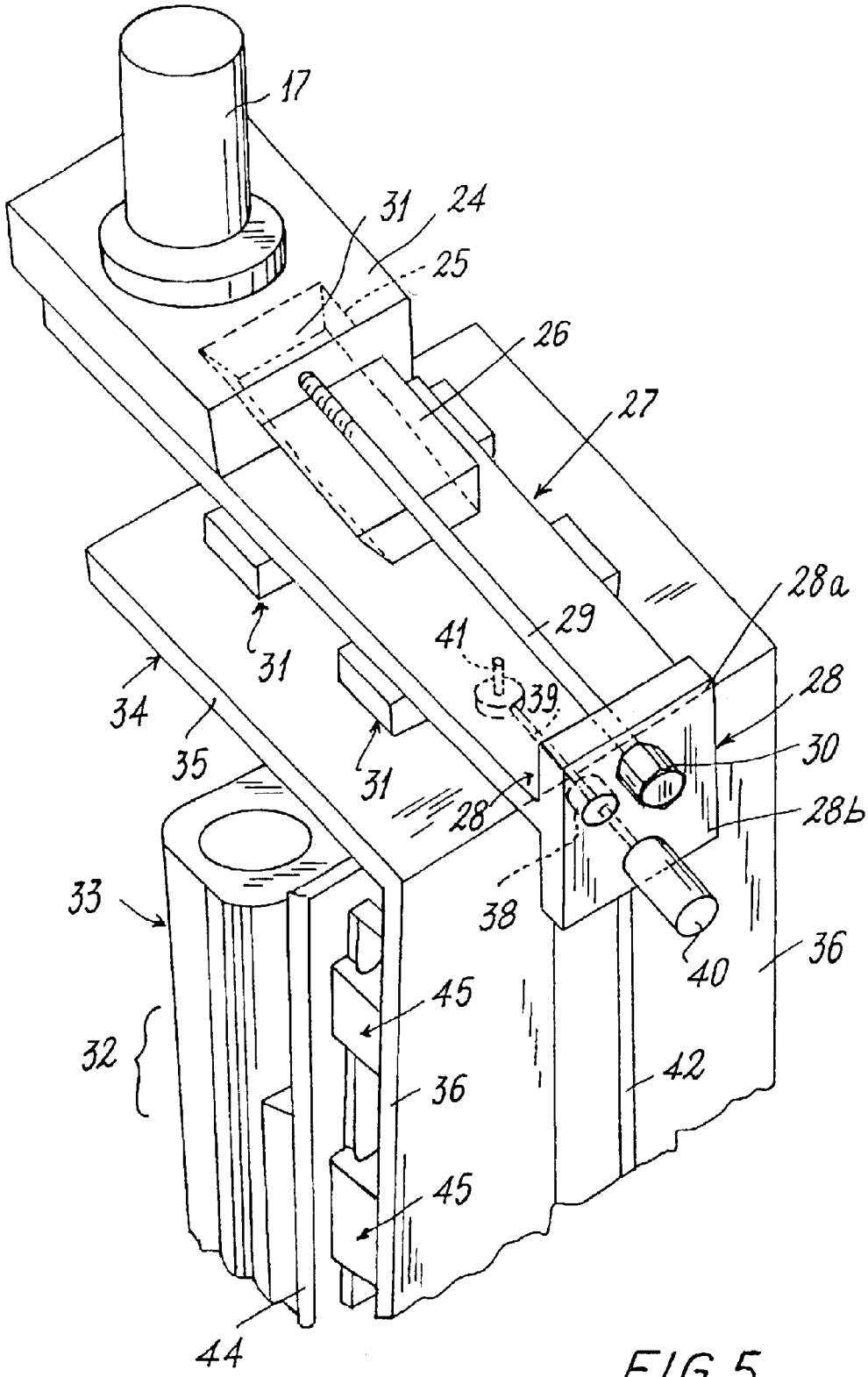
FIG. 5 is a schematic perspective view of parts of the machine of FIG. 4.
Figure 6:
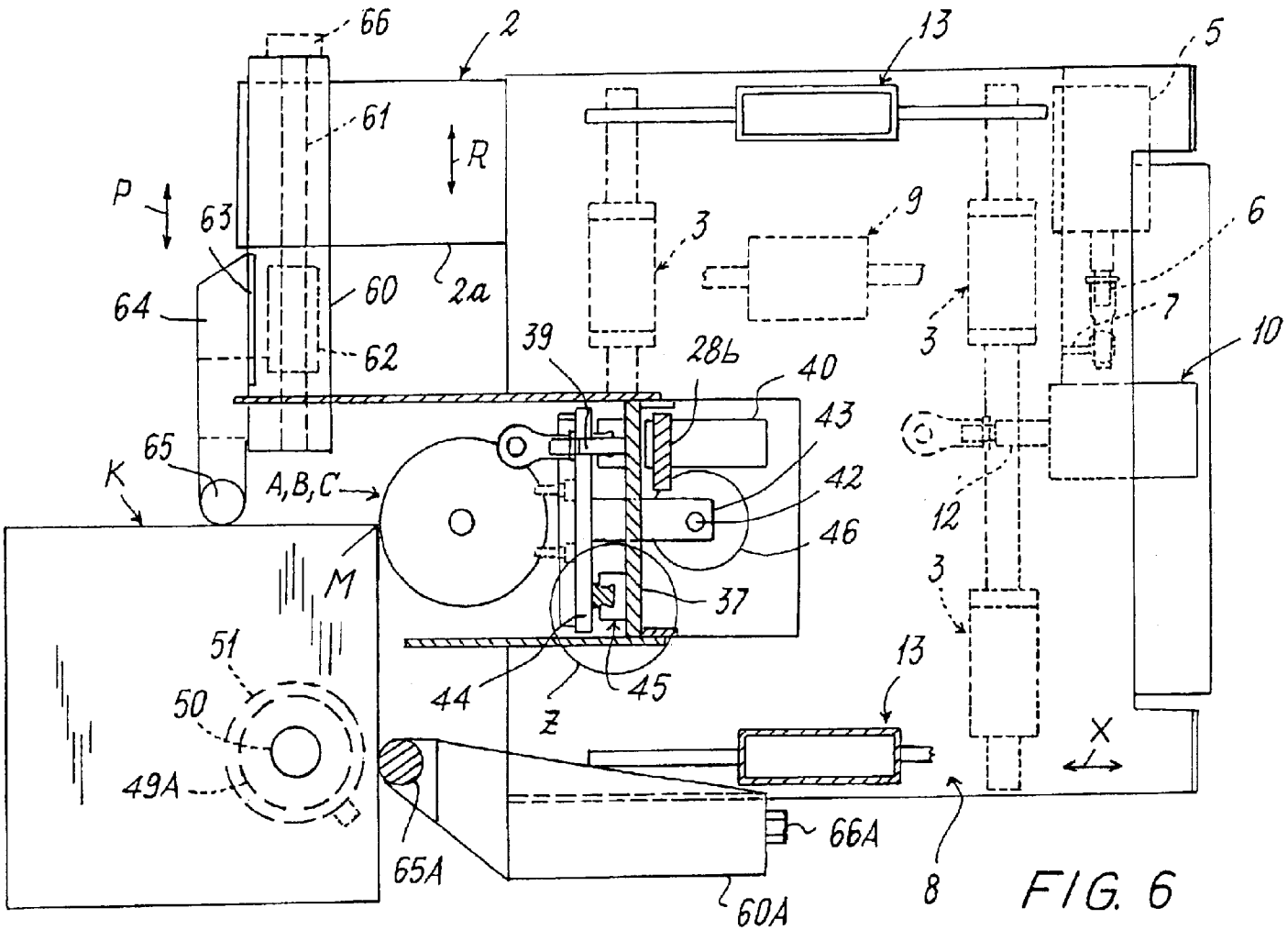
FIG. 6 is a section on the line A—A of FIG. 4.

With particular initial reference to FIGS. 4, 5 and 6 but without excluding reference to the other figures when opportune or necessary, it can be seen that the machine shown presents a bed 1 which can be fixed or movable. The bed 1 carries a first table 2 movable horizontally by way of conventional slide guide means 3. These guide means 3 enable horizontal movement in a direction which, in FIG. 4, is perpendicular to the plane of the drawing. This movement is achieved by a drive means 4. In the illustrated example the drive means 4 is a pressurized fluid cylinder 5 connected to the bed 1 and having its piston rod 6 connected to the first table 2 by a pin 7.

The first table 2 carries a second table 8 movable horizontally by way of conventional slide guide means 9. These slide guide means 9, which are constructionally identical to the guide means 3, enable the second table 8 to move in a direction contained within the plane of the drawing (as shown by the arrows X), i.e. in a direction perpendicular to the direction in which the first table 2 moves. The movement in the direction X is achieved by a drive means 10. In the illustrated example the drive means 10 is a pressurized fluid cylinder 11 connected to the first table 2 and having its piston rod 12 connected to the second table 8.

The second table 8 carries a support structure 13 comprising a pair of spaced-apart sidepieces 13A having an inverted "L" configuration. The two sidepieces 13A are connected together by cross-members 14 situated in correspondence with the horizontal portion of the inverted "L" and also by a further intermediate cross-member 15. At the centre of the cross-member 15 there is mounted a support 16 in which a vertical pin 17 is rotatably supported via radial and thrust bearings 18. The pin 17 is rotated by a drive means 19. This drive means can be an electric motor or a pressurized fluid-operated rotary motor or, more conventionally, as shown by dashed lines in FIG. 4, a pressurized fluid-operated cylinder 20, hinged at one end 21 for example to one of the horizontal portions of the "L" and having its piston rod 22 connected to the pin 17 by a crank coupled to the pin. The dimensioning of the drive system formed by the members 20, 21, 22 and 23 is such as to transmit to the pin 17 a 90° rotation in the two directions for the purpose described hereinafter.

The rotatable pin 17 is connected lowerly to a horizontal head 24 (FIG. 5) having a longitudinal dovetail slot 25 within which a matching formation 26 can slide, rigid with an underlying intermediate member 27 presenting a transverse terminal portion 28.

In the upper part 28A of this terminal portion 28 there is mounted, rotatable but not axially movable, a screw 29 operated by a knob or the like 30 or by a drive means. The screw 29 engages in a threaded hole 31 present in the head 24 connected to the pin 17.

By way of undercut slide means 31 (the configuration of which is equal to that of similar means visible in section in FIG. 6 in the circle Z where they are indicated by 45), the member 27 supports an operator unit 32 comprising an electric motor 33 for driving a group of suitable coaxial grinding wheels or tools A, B, C. The operator unit 32 has a support structure 34 comprising a horizontal upper portion 35, a vertical intermediate portion 36 and a horizontal lower portion 37, conferring on the structure a substantially "Z" configuration.

In the top part of the vertical intermediate portion 36 there is provided a through hole 38 through which there freely passes the piston rod 39 of a pressurized fluid-operated cylinder 40 fixed into the lower part 28*b* of the transverse terminal portion 28 of the intermediate member 27. The piston rod 39 is connected to the upper part 35 of the support structure 34 by a pin 41. The intermediate portion 36 of the support structure 34 presents a central aperture 42 traversed by a perpendicular central extension 43 of a vertical support 44 to which the electric motor 33 is connected. This support 44 is slidably mounted on the intermediate portion 36 of the support structure 34 via undercut slide means 45.

A pressurized fluid cylinder 46 is fixed to the horizontal lower portion 37 and has its piston rod 47 connected to the perpendicular extension 43. The described machine also comprises (see FIG. 4 in particular) means for clamping the glass sheet "K" in its machining position in proximity to the corner to be machined. These clamping means comprise a lower jaw of inflatable/deflatable bellows form 48 mounted on a bracket 49 of the bed 1 and a counter-jaw 49A operated by a pressurized fluid-operated cylinder 50. This latter is mounted in a seat provided in a part 51 rigid with the bed 1.

As already stated, FIG. 6 shows a section taken on the line A—A of FIG. 4. For reasons of representational clarity, FIG. 6 does not show certain components, including the electric motor 33 (replaced by the representation of the grinding wheels or tools A, B, C), whereas the cylinders 5 and 10 for driving the tables 2 and 8 are shown in their effective position rather than the schematic position of FIG. 4. It should also be noted that FIG. 5 differs formally, but not functionally, from that shown in the other FIGS. (4 and 6); this is to facilitate the intelligibility of the machine of the invention.

Returning to FIG. 6, it can be seen that the table 2 presents a lateral appendix 2*a* supporting a tubular member 60 in which there is mounted a lead screw 61 engaging a nut screw 62 connected (via a slot 63 in the tubular member 60) to a suitably bent arm 64 carrying at its end a rotatable pin 65 intended to rest against one side of the sheet "K". By rotating the head 66 of the lead screw 61 the position of the rotatable pin 65 can be varied in the direction of the arrow P.

The upper table 8 also presents a similar rotatable pin, indicated by 65A, intended to rest against the adjacent side of the sheet "K" and adjustable, but in the direction of the arrows "X", by a mechanical arrangement similar to that described in relation to the rotatable pin 65, as apparent by the use of the same reference numerals but with the letter "A" associated.

With the machine in its inoperative position, before radiusing the glass sheet, the value of the radius to be machined has to be set, starting from a position of zero radius. In this initial position, shown in FIGS. 4 and 5, the axis "Y" of the rotatable pin 17 is made to coincide with the tangent to the tools A, B, C passing through the corner to be radiused (indicated by "M" in FIGS. 6 and 8). In this position the sheet "K" is clamped between the jaw 48 and the counter-jaw 49, and the rotatable pins 65 and 65A are applied to two sides of the sheet which converge at the corner M.

Figure 8A:
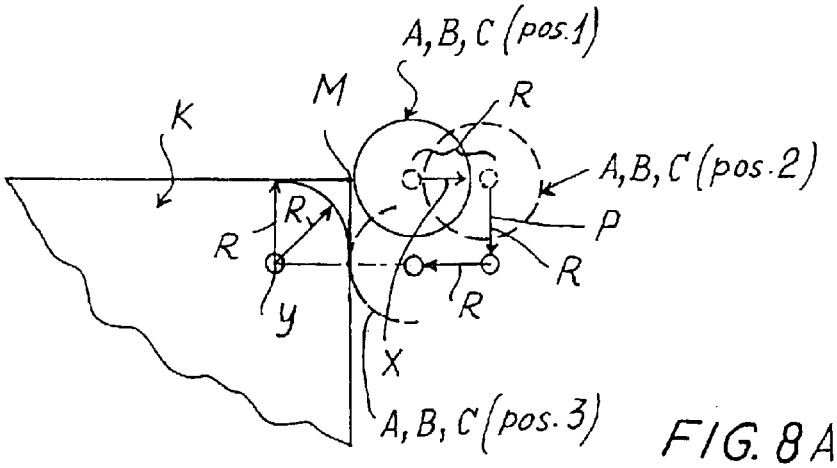
FIGS. 8A, 8B are views from above showing diagrams relative to the setting-up of the machine of FIG. 4 and to its operability.
Figure 8B:
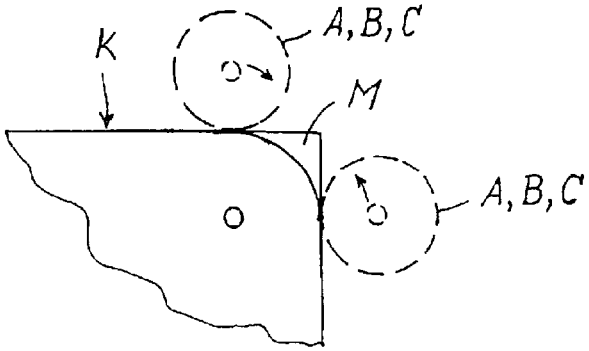

The operator must now set the required radius of curvature for the radiusing operation. For this purpose, by manually adjusting the head 30 or by operating the geared motor which replaces manual intervention, the operator rotates the screw 29 to cause the intermediate member 27 to move rectilinearly towards the right (FIGS. 4 and 5—arrows X), together with the cylinder 40 rigid therewith, the piston rod 39 (which is all to the left), the pin 41, the support member 34 for the motor 33 and the grinding wheels (tools) A, B, C, which move away from the corner M. This is shown in FIG. 8A, where A, B, C (pos. 1) indicates the starting position of the grinding wheels and A, B, C (pos. 2) indicates their position after the movement. The movement corresponds to the desired radius of curvature "R" (FIG. 8A). As is evident, this movement has no effect on the two movable tables 2 and 8. The machine is now set for machining. The tables 2 and 8 are driven by their cylinders 5 and 10 such that the grinding wheels (also representative of the other parts of the machine which effect this movement) move downwards (with reference to the drawing) through a distance "R" from the position A, B, C (pos. 2) in the direction P and then, again by "R", in the direction "X" to reach the position A, B, C (pos. 3) in tangential contact with one side of the glass sheet "K" at the point where radiusing is to commence.

It will be assumed that the grinding wheels are rotating and that the tool (grinding wheel) A is the roughing tool, the tool B the finishing tool and the tool C the polishing tool, and that the grinding wheel A is applied to the sheet (as in FIG. 4). The cylinder 20 is operated so that the pin 17 is rotated such that the grinding wheel A undergoes an angular excursion of 90° (FIG. 8B) about the geometrical axis Y of the pin 17 to hence implement the roughing stage. At this point the cylinder 40 intervenes to move the support structure 34 and hence the motor 33 and grinding wheels A, B, C in such a direction as to withdraw them from the glass sheet. On termination of this withdrawal, the cylinder 46 is operated to move the grinding wheel B (finishing grinding wheel) to the level of the sheet "K". The grinding wheel is applied to the sheet by operating the cylinder 40 in the opposite direction. The cylinder 20 intervenes and causes the grinding wheels to undergo a 90° excursion in the opposite direction to that previously indicated. Hence the finishing stage is implemented, on termination of which, in a manner similar to that stated, the grinding wheel is temporarily separated from the sheet K, the polishing grinding wheel or tool C is positioned at the level of the glass sheet, the sheet is applied to it and the angular excursion of 90° is implemented.

With radiusing thus completed, the roughing grinding wheel A returns to the level of the "new" glass sheet (but displaced from it to be able to commence radiusing), this sheet replacing the already radiused sheet which in the meantime has been removed by opening the jaw 48 and counter-jaw 49A.

The invention finds its most advantageous embodiment in the complex machine of FIGS. from 1 to 3, in that this embodiment enables "in-line" radiusing of glass sheets to be achieved.

Figure 1:
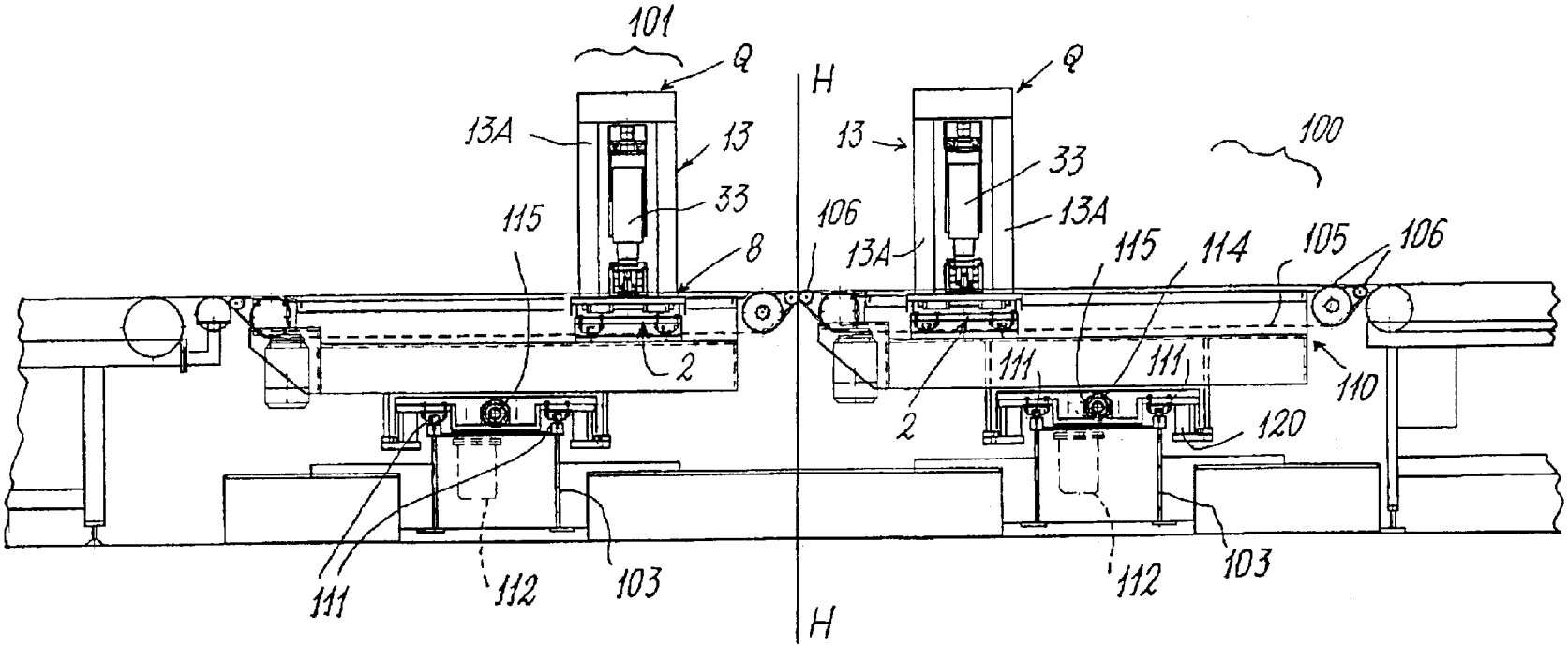
FIGS. 1, 2 and 3 are respectively a side, plan and front schematic view of a machine for the in-line radiusing of glass sheets in accordance with the teachings of the invention.
Figure 2:
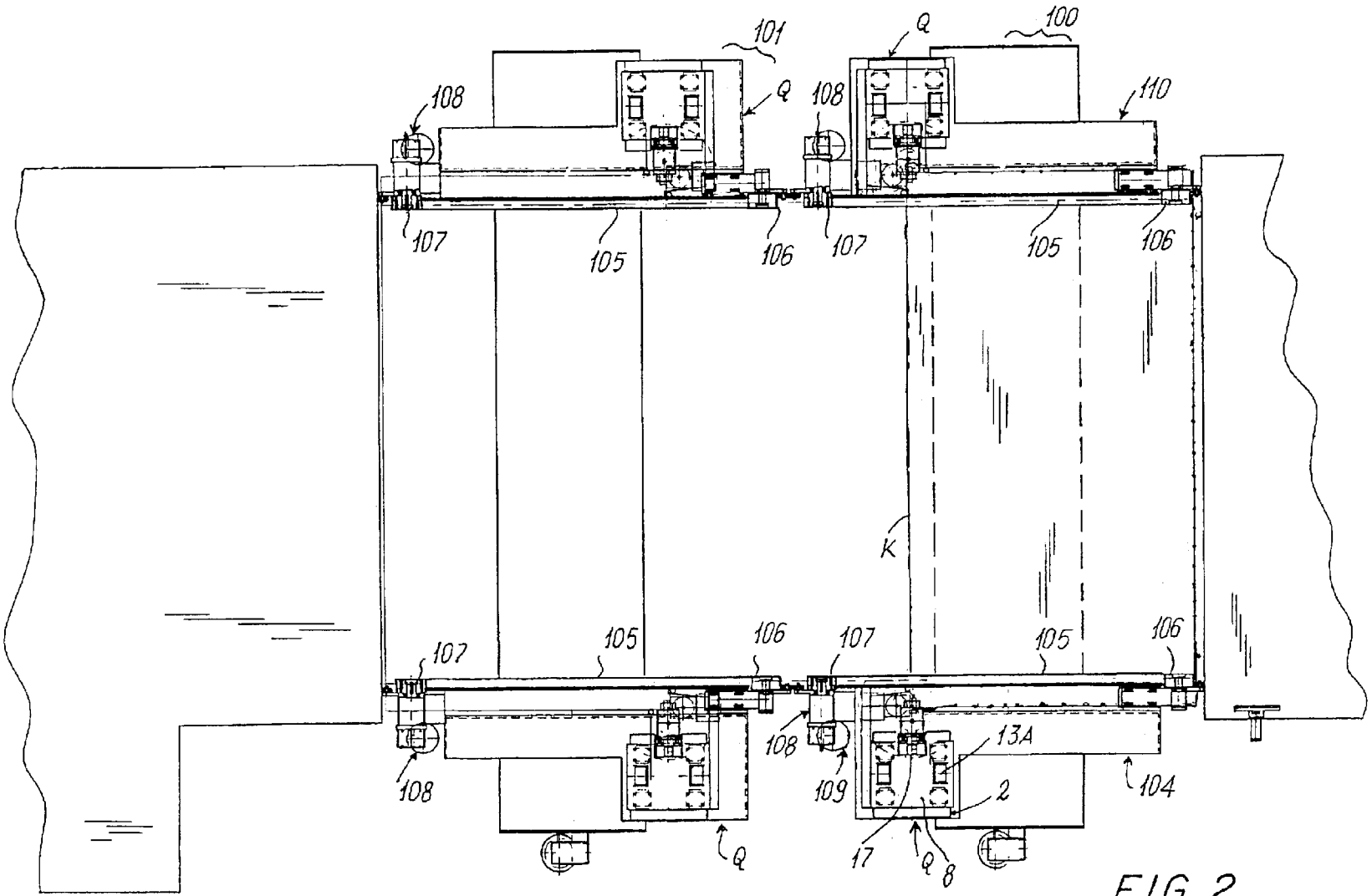
Figure 3:
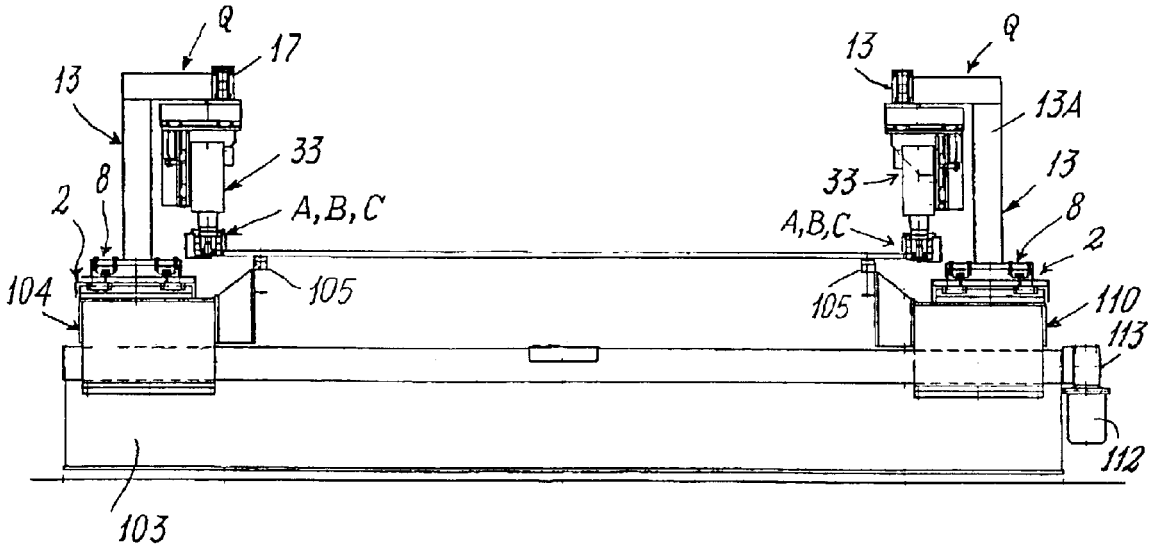

The sheet transport line comprises a known acceleration section the function of which is to separate one sheet from those following. The embodiment of FIGS. 1–3 comprises two aligned working sections 100 and 101 positioned one downstream of the other. The first section (101) radiuses the two front corners of the glass sheet K and the downstream section (102) radiuses the two rear corners.

The two sections are identical and are symmetrical about an ideal vertical plane H—H which separates them. Because of this the description and the reference numerals of one section also apply to the other.

Each section comprises a transverse bed 103, to one end of which there is fixed a fixed cross-member 104 carrying a machine (here indicated by "Q") identical to that already described (FIG. 4 onwards), its parts being indicated by the same reference numerals.

The cross-member 104 presents an endless means (for example a belt) 105 acting as a support and carrier for the glass sheet K. This means 105 extends about reversing pulleys and idle tensioning pulleys 106 and is driven by a pulley 107 operated via a gear transmission 108 by an electric motor 109, preferably of variable speed. A second parallel cross-member 110 completes the section; this is identical to and carries the same members as described for the cross-member 104 (i.e. also including the machine "Q") but with the difference that it is supported by the bed 103 in such a manner as to be able to be moved away from and towards the fixed cross-member 104 to adapt to the format of the glass sheets which are to be radiused at their corners. As can be seen from FIG. 1, the movable cross-member 110 rests on the bed via a slide 120 and rectilinear guides 111 and is driven by an electric positioning motor 112 which by way of a gear transmission 113 rotates a lead screw 114 which is supported in the bed 103 and engages a nut screw 115 rigid with the slide.

By means of the machines Q (FIG. 4 onwards) the section 100 simultaneously radiuses the two front corners of the glass sheet K, which is halted in the working position, for example by the action of sensors. On termination of this radiusing the sheet K is advanced until its two rear corners are brought to the level of action of the two machines Q of the downstream section 101. When radiusing is complete the sheet is fed into the downstream processing line. In the meantime another sheet will have entered the described machine to undergo radiusing.

The radiusing operations proceed in accordance with a program executed by a processor on the basis of data fed in by the user, these relating in particular to the sheet dimensions and the required radius of curvature for the radiusing operation. It should be noted that setting the radius of curvature, which in the embodiment of FIG. 4 is done by manually adjusting the screw 29, can be done by a geared motor controlled by the radius of curvature value fed into the processor by the user.

What is claimed is:

1. A machine for radiusing the corners of glass sheets (K) by tools (A, B, C), comprising:

three different coaxial tools (A, B, C);

an electric motor (33) driving the three different coaxial tools;

a first drive means (46) for vertically moving the electric motor (33);

a first support structure (34) supporting the first drive means (46) and supporting the electric motor (33) so that the electric motor is vertically movable by the first drive means (46);

a rotatable pin (17) defining a vertical axis (Y);

a second support structure (13) rotatably supporting the pin and rotatably supporting the first support structure about the vertical axis (Y);

second support structure (13) movable horizontally in two mutually perpendicular directions (X, R);

an intermediate member (27) slidingly engaged, in an undercut manner, with the first support structure (34);

the pin being slidingly engaged in an undercut manner with the intermediate member (27);

a second drive means (40), supported by the intermediate member (27), operationally connected to said first support structure (34); and a screw means (29);

the intermediate member (27) cooperating with the pin (17) via the screw means (29) for setting the radius of curvature of a radiusing operation.

2. A machine as claimed in claim 1, wherein the first support structure (34) is movable horizontally with respect to the vertical axis (Y) to determine the radius of curvature of the radiusing operation.

3. A machine as claimed in claim 1, wherein the horizontal mobility of the second support structure (13) is achieved by two superposed tables (2, 8), each driven by a drive means (4, 10).

4. A machine as claimed in claim 3, wherein a first (2) of the two tables (2, 8) is supported via slide and guide means (3) by the machine bed (1), the second (8) of the two tables (2, 8) being supported via slide and guide means (8) of the first (2) of said tables (2, 8).

5. A machine as claimed in claim 1, wherein the pin (17) is operationally connected to a third drive means (19 or 20, 21, 22, 23) arranged to transmit a 90° rotation to the pin (17).

6. A machine as claimed in claim 1, wherein clamping means (48, 49A, 50) for the sheet (K) are associated with the machine.

7. A machine as claimed in claim 1, wherein adjustable centering means (65, 65A) applicable to the glass sheet (K) are provided, carried respectively by the first and by the second table (2, 8).

8. A machine as claimed in claim 1, characterised by being associated with three other substantially identical machines (FIGS. 1, 2, 3) for the in-line radiusing of glass sheets (K), a first pair of said machines (Q) serving for radiusing the two front corners of the glass sheets and a second pair for radiusing the two rear corners of said sheets.

9. A machine as claimed in claim 8, wherein in each pair of machines (Q), one machine of the pair is movable away from and towards the other machine of the pair.

10. A machine as claimed in claim 8, wherein an endless driven means (105) for supporting and transporting the glass sheets (K) is associated with each machine.

11. A machine as claimed in claim 9, wherein an endless driven means (105) for supporting and transporting the glass sheets (K) is associated with each machine.

12. A machine for radiusing corners of glass sheets (K), comprising:

a group of three coaxial tools (A, B, C);

an electric motor (33) driving each of the three different coaxial tools;

a first drive means (46) for vertically moving the electric motor (33);

a first support structure (34) horizontally supporting the first drive means (46) and vertically supporting the electric motor (33), via a slide mechanism (44, 45) connected to the first drive means, so that the electric motor is vertically movable by the first drive means (46);

a rotatable pin (17) defining a vertical axis (Y);

a second support structure (13) rotatably supporting the pin and rotatably supporting the first support structure about the vertical axis (Y);

the second support structure (13) movable horizontally in two mutually perpendicular directions (X, R);

an intermediate member (27) slidingly engaged, in an undercut manner, with the first support structure (34);

the pin being slidingly engaged in an undercut manner with the intermediate member (27);

a second drive means (40), supported by the intermediate member (27), operationally connected to said first support structure (34); and a screw means (29);

the intermediate member (27) cooperating with the pin (17) via the screw means (29) for setting the radius of curvature of a radiusing operation.

13. A machine for radiusing corners of glass sheets (K), comprising:

plural coaxial tools (A, B);

an electric motor (33) driving each of the tools;

a first drive (46) for vertically moving the electric motor (33);

a first support structure (34) horizontally supporting the first drive (46) and vertically supporting a slide mechanism (44) supporting the electric motor so that the electric motor is vertically movable by the first drive means (46);

a rotatable pin (17) defining a vertical axis (Y);

a second support structure (13) rotatably supporting the pin and rotatably supporting the first support structure about the vertical axis (Y);

the second support structure (13) movable horizontally in two mutually perpendicular directions (X, R);

an intermediate member (27) slidingly engaged, in an undercut manner, with the first support structure (34);

the pin being slidingly engaged in an undercut manner with the intermediate member (27);

a second drive means (40), supported by the intermediate member (27), operationally connected to said first support structure (34); and a screw means (29);

the intermediate member (27) cooperating with the pin (17) via the screw means (29) for setting the radius of curvature of a radiusing operation.

* * * * *